US008116668B2

(12) United States Patent
Koyanagi et al.

(10) Patent No.: US 8,116,668 B2
(45) Date of Patent: Feb. 14, 2012

(54) TONER SUPPLYING ROLLER, DEVELOPING APPARATUS, AND IMAGE FORMING APPARATUS

(75) Inventors: Masato Koyanagi, Mishima (JP); Shinji Katagiri, Yokohama (JP); Masahiro Yoshida, Tokyo (JP); Kazunori Hashimoto, Numazu (JP); Hisashi Yamauchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 342 days.

(21) Appl. No.: 12/470,726

(22) Filed: May 22, 2009

(65) Prior Publication Data

US 2009/0297230 A1 Dec. 3, 2009

(30) Foreign Application Priority Data

May 27, 2008 (JP) ..... 2008-138052
Sep. 30, 2008 (JP) ..... 2008-253997

(51) Int. Cl.
*G03G 15/09* (2006.01)

(52) U.S. Cl. ..... 399/281; 399/265; 399/286

(58) Field of Classification Search ..... 399/265, 399/272, 281, 286; 492/49, 53; 28/892
See application file for complete search history.

(56) References Cited

U.S. PATENT DOCUMENTS

| | | | |
|---|---|---|---|
| 5,768,668 | A | 6/1998 | Shiraki et al. |
| 6,847,796 | B2 | 1/2005 | Chigono et al. |
| 6,909,869 | B2 | 6/2005 | Yamamoto et al. |
| 6,952,551 | B2 | 10/2005 | Koyanagi et al. |
| 7,209,690 | B2 | 4/2007 | Koyanagi et al. |
| 7,239,832 | B2 | 7/2007 | Takashima et al. |
| 2007/0201907 | A1 | 8/2007 | Baba et al. |

FOREIGN PATENT DOCUMENTS

JP 2006-187940 A 7/2006

*Primary Examiner* — David Gray
*Assistant Examiner* — Barnabas Fekete
(74) *Attorney, Agent, or Firm* — Fitzpatrick, Cella, Harper & Scinto

(57) ABSTRACT

A toner supplying roller which is used in a developing apparatus and has the following characteristics: (1) an average diameter of a foam cell opening portion on a surface of a foam elastic member is 100 to 800 μm, (2) an unopened cell closed by a skin layer of a film thickness of 50 μm or less is present in the surface of the foam elastic member, and (3) assuming that a surface area of the foam elastic member is A, a total area of the foam cell opening portions is B, and a surface area of the unopened cell is C, the following relationship is satisfied:

$$\frac{B}{A} + 0.2 \leqq \frac{B+C}{A} \leqq 0.95.$$

7 Claims, 3 Drawing Sheets

TONER SUPPLYING ROLLER, DEVELOPING APPARATUS, AND IMAGE FORMING APPARATUS

BACKGROUND OF THE INVENTION

1. Field of the Invention

The present invention relates to a toner supplying roller in a developing apparatus in an image forming apparatus employing an electrophotographic printing method or an electrostatic recording method, a developing apparatus, and an image forming apparatus.

2. Description of the Related Art

In an image forming apparatus such as an electrostatic copying machine and a printer, a latent image on a photosensitive member is developed into a developer image by toner that is a developer from a developing roller of a developing unit and visualized. In this case, in the developing unit, toner conveyed with being agitated is supplied onto the developing roller by a supplying roller. Then, the toner is conveyed to a developing portion where the photosensitive member and the developing roller are opposed to each other, with a thickness of a toner layer being adjusted by a toner regulating member (hereinafter, referred to as a developing blade) on the developing roller.

Recently, the above-mentioned image forming apparatus is required to perform higher speed printing and suppress power consumption. Accordingly, toner with a low viscoelasticity, which can be fixed with a small amount of heat, is selected to be used in many cases.

In contrast, the toner supplying roller is required to supply the toner onto the developing roller, scrape off unnecessary toner, and supply the toner uniformly to the developing roller. In order to satisfy those two functions, a roller with satisfactory open cells formed at the surface thereof has been developed.

However, in a laser beam printer (LBP) using toner of a low viscoelasticity, the state of the toner may change (e.g., flowability of toner may decrease) depending upon the use conditions thereof or the number of sheets to be used, as the use of the developing apparatus progresses. In this case, a toner inhaling amount by the toner supplying roller and an exhaling amount to the developing roller may change.

In such a case, in a developing apparatus using the above-mentioned toner supplying roller, the supply amount of the toner changes depending upon a ratio of the total area of foam cell opening portions to the surface area of the toner supplying roller (hereinafter, referred to as opening ratio). When the opening ratio is large, the image defects may be caused by an excess supply of the toner to the developing roller when the developing apparatus is new. When the opening ratio is small, the image defects may be caused due to shortage of the toner supply as the use of the developing apparatus progresses. Therefore, it becomes very difficult to appropriately set the opening ratio of the toner supplying roller.

SUMMARY OF THE INVENTION

Therefore, it is an object of the present invention to provide a toner supplying roller, a developing apparatus, and an image forming apparatus which prevent image defects due to excess or shortage of toner supply through a life of a developing apparatus.

Further features of the present invention become apparent from the following description of exemplary embodiments with reference to the attached drawings.

DESCRIPTION OF THE EMBODIMENTS

Hereinafter, an image forming apparatus of the present invention will be described in detail with reference to the drawings. Embodiments described below are shown for exemplarily illustrations of the present invention, and the scope of the present invention is not limited to the dimensions, materials, shapes, relative positions, etc. of components described below unless otherwise specified.

EMBODIMENTS

Embodiment 1

A toner supplying roller of the present invention includes a toner containing portion containing toner as a developer, a toner supplying roller, and a developing roller (toner carrying member), and is mounted in a developing apparatus that supplies toner to an electrostatic latent image on the surface of a photosensitive member to form a toner image. As an example of such a developing apparatus, there is a laser printer illustrated in FIG. 1.

Figure 1:
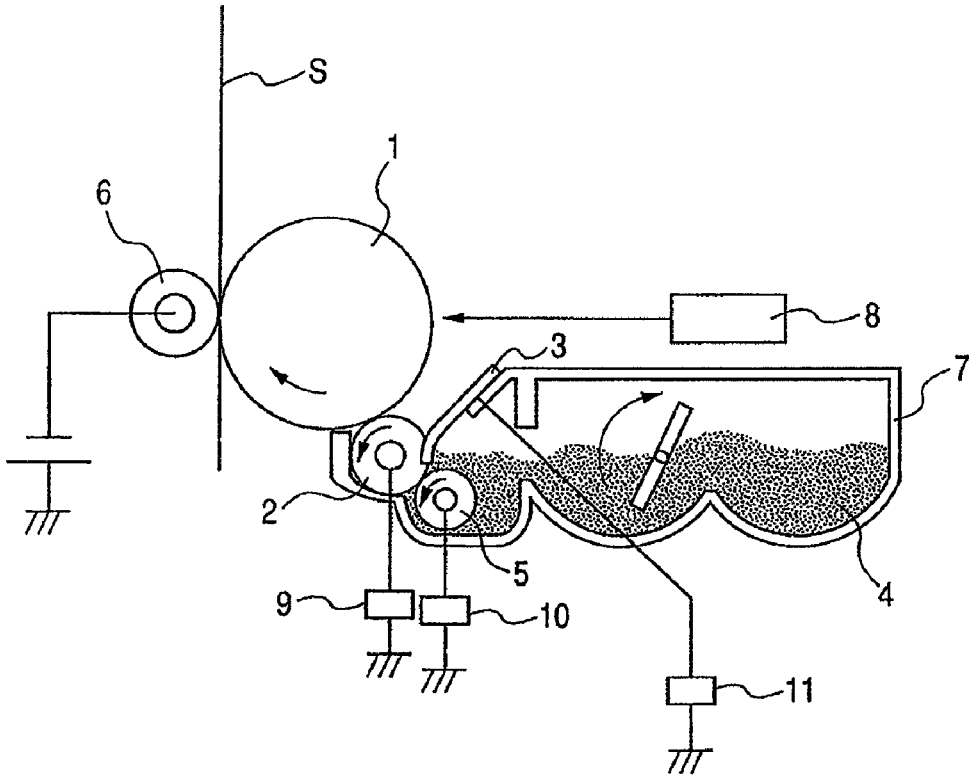
FIG. 1 is a schematic cross-sectional view of one embodiment of a developing apparatus according to the present invention.

FIG. 1 is a schematic cross-sectional view illustrating a configuration of an image forming apparatus of the present invention. An image forming process by a reversal development of the present invention will be described briefly with reference to FIG. 1. First, a photosensitive drum (an image carrying member) 1 is uniformly charged negatively by a charging roller (not shown). Next, the surface of the photosensitive drum 1 is exposed to laser light of a scanner 8, which is an image-forming unit, whereby an electrostatic latent image is formed on the photosensitive drum 1. Then, a negative developer supplied by a developing apparatus 7 comes into contact with the photosensitive drum 1 by a developing roller (a toner carrying member) 2, whereby the electrostatic latent image is developed into a developer image. The developer image is transferred to a recording medium S by applying a positive bias to the transfer roller 6. After that, an unfixed toner image on the recording medium S is permanently fixed to the recording medium S with heat and a pressure by a fixing device (not shown).

Next, the details of the developing apparatus 7 according to an embodiment of the present invention will be described.

The developing apparatus 7 is opened over a substantially entire region of the photosensitive drum 1 in a longitudinal direction. The developing roller 2 that is a roller-shaped toner carrying member is disposed at the opening. The developing roller 2 is pressed against and brought into contact with the photosensitive drum 1 positioned on the upper left side of the developing apparatus 7 in FIG. 1 so that the developing roller 2 inroads into the photosensitive drum 1 by a predetermined inroad amount, and is rotated in a direction indicated by an arrow in FIG. 1.

Figure 2:
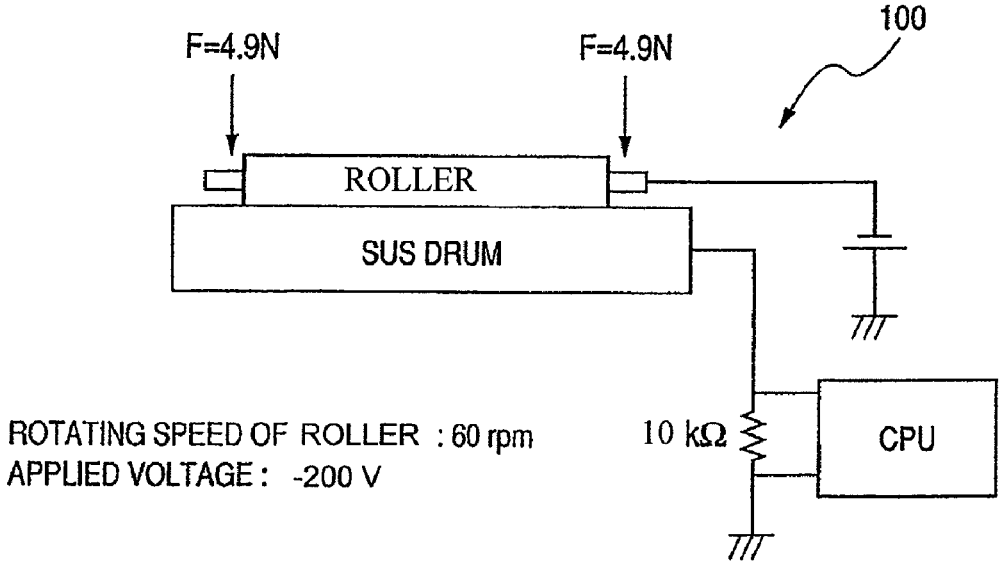
FIG. 2 is a view illustrating a method of measuring a resistance of a developing roller and a toner supplying roller of this embodiment.

On the lower right side of the developing roller 2 in FIG. 1, a toner supplying roller 5, as means for stabilizing the supply amount of a developer to the developing roller 2, inroads into the developing roller 2 by 1.25 mm so as to abut against the developing roller 2. The toner supplying roller 5 is rotatably supported by a developing container 4. In this embodiment, in order to keep a uniform toner layer on the developing roller 2, a predetermined DC current bias is applied from a bias voltage application unit 10 to the toner supplying roller 5. In this embodiment, the toner supplying roller 5 is supplied with a voltage of −500 V. As electric resistance values capable of making the toner coat amount on the developing roller 2 uniform, $2\times10^5\Omega$ of the developing roller and $3\times10^7\Omega$ of the toner supplying roller are adopted. FIG. 2 illustrates a resistance measuring apparatus 100 including a CPU and a 10 kΩ load resistor. The resistance values of the developing roller and the toner supplying roller are obtained by pressing the developing roller and the toner supplying roller to a metal drum (SUS drum), respectively with a predetermined load (F=4.9 N) and rotating at a speed of 60 rpm, as illustrated in FIG. 2, and applying −200 V.

Further, the developing apparatus 7 includes a developing blade 3 as a regulating member that regulates the amount of toner to be carried on the developing roller 2. The developing blade 3 is formed of a thin metal plate of phosphor bronze having elasticity, and is provided so that the vicinity of the tip end on a free end side comes into area contact with the outer peripheral surface of the developing roller 2. The toner carried on the developing roller 2 due to the rubbing against the toner supplying roller 5 is charged by triboelectrification when passing through an abutting portion with respect to the developing blade 3 and is regulated to a thin layer. In this embodiment, in order to prevent toner from being fusion-bonded to the developing blade 3, a DC current bias of −500 V is applied by a bias voltage application unit 11. The toner with the thickness of the toner layer adjusted is conveyed to the developing portion that is an opposed portion of the photosensitive member and the developing roller, and an electrostatic latent image on the photosensitive member is developed into a developer image by the toner.

In this embodiment, in the developing apparatus with such a configuration, the developing roller 2 is supplied with a DC voltage of −300 V as a developing bias from a bias voltage application unit 9. Thus, in this embodiment, an exposed portion of which a negative charge is decayed in the uniformly charged surface of the photosensitive drum 1 is developed by the reversal development.

In this embodiment, as the toner 4, a substantially spherical toner having excellent fixing properties and low viscoelasticity was used during high-speed printing. As the developing roller 2, an elastic roller was used, which includes silicon rubber as a base layer and is coated with urethane resin as a surface layer. The hardness is Asker C hardness of 50° and MD-1 hardness of 40°.

Figure 3A:
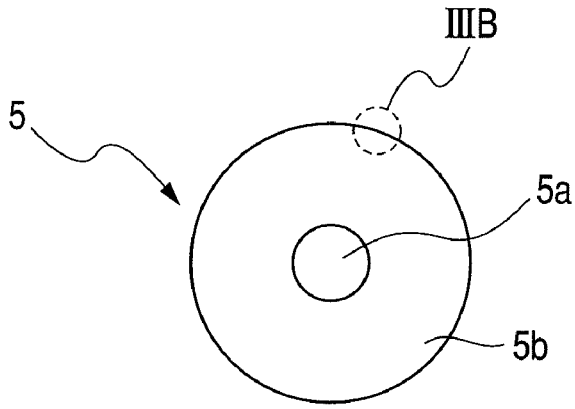
FIGS. 3A and 3B are cross-sectional views of a toner supplying roller of the present invention.
Figure 3B:
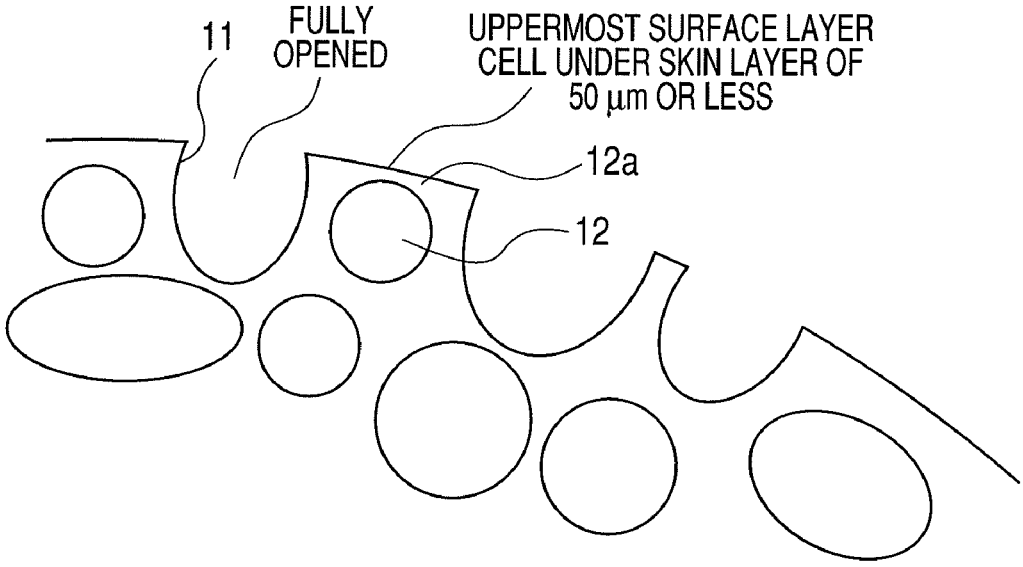

The present invention relates to the toner supplying roller 5 used in the developing apparatus 7 with such a configuration. The toner supplying roller 5 has a foam elastic member on the surface thereof, and the average diameter of the foam cell opening portions on the surface thereof is 100 to 800 μm. The average diameter is obtained by photographing the surface of the toner supplying roller 5 with Ultra-deep Color 3D Profile Measuring Microscope VK-9500 manufactured by KEYENCE CORPORATION. Then, the cell opening diameter of the surface picture image was measured and an average thereof was obtained. The cell opening diameter also includes an unopened cell diameter that is closed with a skin layer having a film thickness of 50 μm described later. The toner supplying roller 5 is formed, for example, by forming a predetermined soft polyurethane sponge layer around a cored bar by the integral foam molding. The polyurethane sponge layer has a skin layer forming a continuous smooth surface. Further, the present invention is characterized in that each cell immediately below the skin layer is present in the following states (1) and (2). (1) The cells are opened outside independently through the openings formed on the skin layer. (2) The uppermost surface layer cell is present under the skin layer of 50 μm or less. The present invention has a remarkable feature in that the cells are present in the states (1) and (2) at a predetermined ratio. FIG. 3B illustrates an example thereof.

Figure 4A:
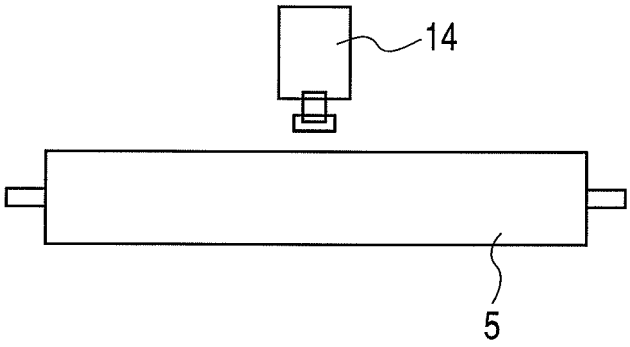
FIG. 4A is a view illustrating a toner supplying roller and a microscope.
Figure 4B:
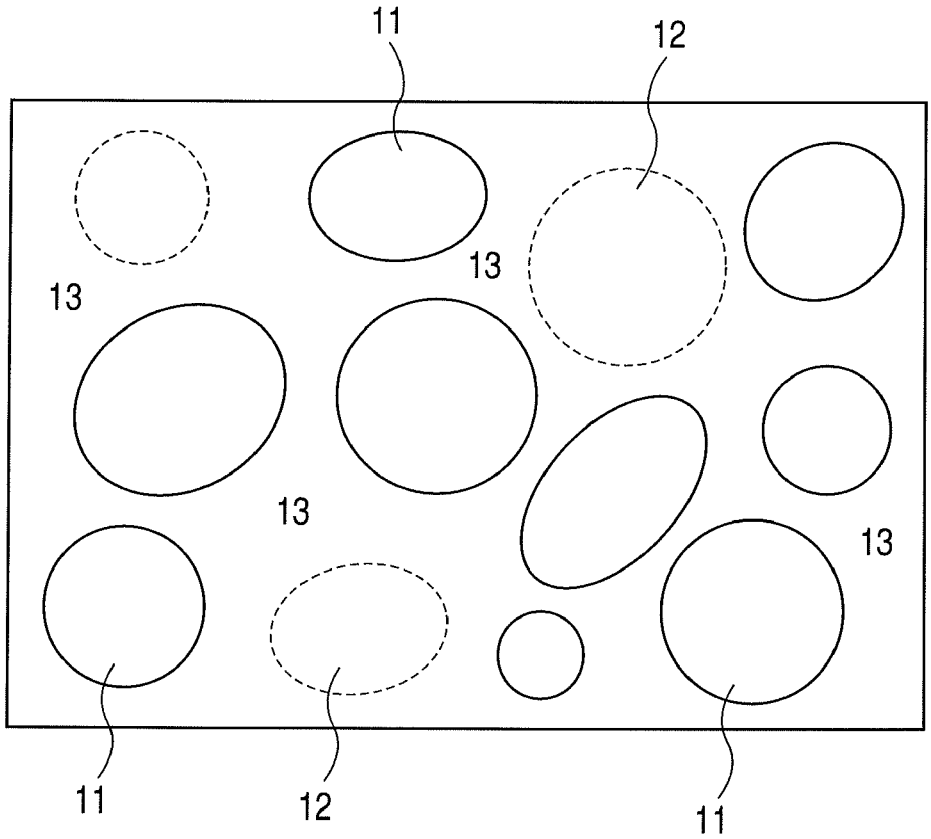
FIG. 4B is a view illustrating the surface of the toner supplying roller of the present invention.

Hereinafter, the opening state of the surface foam cell of the toner supplying roller, which is the feature of the present invention, will be described with reference to FIGS. 3A, 3B, 4A, and 4B. FIG. 3A is a cross-sectional view of the toner supplying roller 5. The toner supplying roller 5 includes a cored bar 5*a* and a polyurethane sponge layer 5*b* around the cored bar 5*a*. FIG. 3B is a view of a portion surrounded by a circle IIIB of FIG. 3A in an enlarged state. FIG. 4A illustrates the toner supplying roller 5 and a microscope 14. FIG. 4B is a view schematically illustrating a surface of the toner supplying roller photographed through the microscope 14. As illustrated in FIG. 3B, the toner supplying roller 5 of the present invention includes both (1) opened cells and (2) unopened cells in the foam cells of the uppermost surface layer. As illustrated in FIG. 4A, when the surface of the toner supplying roller 5 is photographed with a microscope 14, there are observed opened portions 11 (solid line) and unopened portions 12 (dotted line), as illustrated in FIG. 4B. The unopened portion 12 has a skin layer 12*a* having a film thickness of 50 μm, as illustrated in FIG. 3B. The toner supplying roller 5 is rotated to break the skin layer 12*a*, which will become an opening. The opened portions 11, unopened portions 12, and a skeletal structure portion 13 can be determined apparently from the photographed surface schematically illustrated in FIG. 4B. More specifically, the opened portions 11 and the unopened portions 12 can be determined since an edge portion of a cell is obtained from the photographed area. The opened portions 11 and the unopened portions 12 are different in reflected light from one another, and hence, are different in hue of images. Thus, the opened portions 11 and the unopened portions 12 can be determined based on the hues. In this embodiment, the surface and the cross-section of the toner supplying roller were observed by Ultra-deep Color 3D Profile Measuring Microscope VK-9500 manufactured by KEYENCE CORPORATION. Regarding the measurement of an area, an image of the surface is captured and is subjected to binarization by image analysis, whereby a ratio of an area with respect to a photographed area (%) was obtained.

Assuming that, in the photographed picture in FIG. 4B, the photographed area is A, the area of the opened portions 11 is B, the area of the unopened portions 12 is C, and the area of the skeletal structure portion 13 is D, the area ratio of the opened portions 11 is B/A, the area ratio of the unopened portions 12 is C/A, and the area ratio of the skeletal structure portion 13 is D/A. It is a foregone conclusion that A=B+C+D. Hereinafter, B/A is referred to as the opening ratio. However, there are the unopened portions 12 in the toner supplying roller of the present invention, and hence the opening ratio increases as the driving of the toner supplying roller progresses (described later in detail).

First, in the image forming apparatus in this embodiment, the results using a conventional toner supplying roller (in which all the surface cells are opened) will be described. The results are the relationship between the opening ratio and the defects of images. In this embodiment, in order to achieve high-speed printing and energy saving, toner having a low viscoelasticity enabling fixing at low temperature is adopted. The flowability of toner decreases due to the degradation thereof, and hence the appropriate opening ratio at a time when the toner supplying roller is new is different from that at a time when the toner supplying roller has reached the end of life (the last stage of use) in which the driving of the toner supplying roller has progressed.

TABLE 1

| | | | Fogging | | Solid image follow-up failure | |
|---|---|---|---|---|---|---|
| | | Opening ratio (%) | Initial stage | End of life | Initial stage | End of life |
| Conditions for consideration | 1 | 25 | ○ | ○ | x | x |
| | 2 | 30 | ○ | ○ | ○ | x |
| | 3 | 40 | ○ | ○ | ○ | x |
| | 4 | 50 | ○ | ○ | ○ | ○ |
| | 5 | 60 | x | ○ | ○ | ○ |
| | 6 | 90 | x | ○ | ○ | ○ |

The "fogging" shown in Table 1 refers to the so-called fogging phenomenon in which toner adheres to a blank image. The fogging occurs as follows: when the opening ratio of the toner supplying roller is large, the toner supply amount from the toner supplying roller to the developing roller becomes too large, and the low-charged toner electrostatically coagulates to the charged-up toner; as a result, the toner cannot be regulated by a developing blade to cause fogging. The fogging occurs when the opening ratio is large in a new developing apparatus with high toner flowability.

The "solid image follow-up failure" refers to the phenomenon in which an A4-sized solid image cannot be drawn over an entire surface. The solid image follow-up failure occurs when the inhaling amount of toner of the toner supplying roller and the exhaling amount of toner to the developing roller decrease in the case where the opening ratio of the toner supplying roller is small. The solid image follow-up failure occurs as the opening ratio is smaller at a time of the end of life of the developing apparatus in which the flowability of toner decreases.

According to the results, when the opening ratio is small, the solid image follow-up failure occurs due to the shortage of the toner supply amount at the end of life of the developing apparatus, and when the opening ratio is large, the fogging occurs due to the excess supply amount of the toner at a time when the developing apparatus is new. Further, when the opening ratio is 25%, the solid image follow-up failure occurs even at a time when the developing apparatus is new. That is, in the configuration of the developing apparatus of this embodiment, the defects of images do not occur in the vicinity of 50% of the opening ratio. However, it is very difficult to form a polyurethane sponge layer only in the vicinity of 50% of the opening ratio.

In contrast, the toner supplying roller of the present invention is characterized in that unopened cells having a skin layer with a film thickness of 50 μm or less are previously formed, and the above-mentioned B/A·C/A·D/A is set to have a predetermined relationship. This can change the opening ratio actively throughout the life and keep the toner supply amount to be appropriate. First, the relationship between the B/A·C/A·D/A of the toner supplying roller of the present invention, the opening ratio, and the number of images to be formed is shown in Table 2.

TABLE 2

| | | Number of images to be formed | Opening ratio (%) | Area ratio (%) B/A | C/A | D/A |
|---|---|---|---|---|---|---|
| Conditions for consideration | 1 | 0 | 30 | 30 | 60 | 10 |
| | | 500 | 78 | 78 | 12 | 10 |
| | | 1000 | 90 | 90 | 0 | 10 |
| | 2 | 0 | 30 | 30 | 20 | 50 |
| | | 500 | 46 | 46 | 4 | 50 |
| | | 1000 | 50 | 50 | 0 | 50 |
| | 3 | 0 | 50 | 50 | 45 | 5 |
| | | 500 | 86 | 86 | 9 | 5 |
| | | 1000 | 95 | 95 | 0 | 5 |
| | 4 | 0 | 50 | 50 | 25 | 25 |
| | | 500 | 70 | 70 | 5 | 25 |
| | | 1000 | 75 | 75 | 0 | 25 |

The developing apparatus used for forming images in this embodiment can print 1000 sheets, and in this experiment, the coverage rate was set so that a developer would be used up (out of toner) at a time of the printing of 1000 sheets. The toner supplying roller opening ratio under the conditions for consideration 1 and 2 is 30% at a time when the developing apparatus is new. At the end of life of the developing apparatus, the opening ratio has reached 50%, which shows that the solid image follow-up properties are satisfactory. Further, the opening ratio is 46% when 500 sheets of images are formed under the condition for consideration 2, and the solid image follow-up properties are satisfactory because the toner has not been degraded. The toner supplying roller opening ratio under the conditions for consideration 3 and 4 is 50% when the developing apparatus is new, and thus, no problems arise though the opening ratio increases along with the formation of images.

According to the experimental results, 80% of the skin layer of a film thickness of 50 μm or less closing the uppermost surface layer cells in the toner supplying roller of the present invention is broken by the operation of printing 500 sheets and 100% thereof is broken by the operation of printing 1000 sheets. In an electrophotographic image forming apparatus that does not reach the end of life at a time of printing 1000 sheets or less, the uppermost surface layer cells are opened by 100% at a time of the end of life, whereby an appropriate opening ratio can be obtained. Further, the broken chips are confirmed under the toner supplying roller, which does not disturb the toner coat on the developing roller.

According to those experimental results, the skin layer with a film thickness of 50 μm or less closing the uppermost surface layer cells is broken as a whole at a time of the end of life of the developing apparatus, and hence the opening ratio at a time when the developing apparatus is new is B/A and the opening ratio at a time of the end of life of the developing apparatus is (B+C)/A. According to the above-mentioned experimental results, it is desirable that the opening ratio required at a time when the developing apparatus is new is 30%≦opening ratio≦50% and the opening ratio required at a time of the end of life of the developing apparatus is 50%≦opening ratio≦95%. Note that the desirable range of the opening ratio depends upon the potential difference between the supplying roller and the developing roller. According to the study by the inventors of the present invention, a bias applied to the supplying roller is changed in a range of −800 V to −500 V, whereby satisfactory results can be obtained with the above-mentioned opening ratio even when the range of the optimum opening ratio is studied. Thus, satisfactory results are obtained by the above-mentioned opening ratio when an electric field at which toner is directed to the developing roller is formed between the developing roller and the supplying roller, and when the potential difference is between 500 V and 200 V.

Further, there is an opening ratio production variation of about ±10% in the toner supplying roller of a polyurethane sponge layer adopted in this embodiment. Therefore, in the case where the toner supplying roller is produced at an opening ratio of 40±10(%), at least 20% is required as an opening ratio increase percentage. Further, 5% of D/A of the skeletal structure portion is required in order for the toner supplying roller in this embodiment to have hardness and elasticity at least required for forming images, and hence the opening ratio at a time of the end of life is 95% or less.

Further, it is confirmed from an experiment other than the above-mentioned experiment that the skin layer of 60 μm or more covering the uppermost surface layer cells is not broken at a time of forming 5000 sheets of images. Therefore, the skin layer closing the uppermost surface layer cells of the toner supplying roller of the present invention is set to be 50 μm or less.

According to this embodiment, when the surface area of the toner supplying roller is A, the total area of the foam cell opening portions is B, and the surface area of the unopened cells is C, a developing apparatus in which the defects of images do not occur can be provided by satisfying the following relationship:

$$\frac{B}{A} + 0.2 \leqq \frac{B+C}{A} \leqq 0.95.$$

In this embodiment, the configuration has been shown in which a blade bias and a supply bias are applied to the developing roller. However, the present invention is not limited to this embodiment described above. As long as a predetermined toner coat amount is obtained on the developing roller, the present invention is applicable to all the developing apparatuses having a toner supplying roller.

Embodiment 2

Next, another embodiment of the image forming apparatus according to the present invention will be described.

In Embodiment 2, there is no means for applying a supply bias to the developing roller in the developing apparatus described in Embodiment 1. In this embodiment, a bias of −300 V is applied to the developing roller, and thus, the potential of the developing roller is the same as that of the supplying roller. Further, in this embodiment, a bias of −400 V is applied to the developing blade. In this case, there is no toner supplying electric field from the supplying roller to the developing roller by a bias, and hence the relationship between the opening ratio and the defects of images are different from that in Embodiment 1. In this case, a larger supply ability by the toner supplying roller itself is required, which is as shown in Table 3. Those results are obtained by using a conventional toner supplying roller.

TABLE 3

| | | | Fogging | | Solid image follow-up failure | |
|---|---|---|---|---|---|---|
| | | Opening ratio (%) | Initial stage | End of life | Initial stage | End of life |
| Conditions for consideration | 1 | 50 | ○ | ○ | x | x |
| | 2 | 55 | ○ | ○ | ○ | x |
| | 3 | 70 | ○ | ○ | ○ | x |
| | 4 | 75 | ○ | ○ | ○ | ○ |
| | 5 | 80 | x | ○ | ○ | ○ |
| | 6 | 95 | x | ○ | ○ | ○ |

According to the results, when the opening ratio is small, the solid image follow-up failure occurs due to the shortage of the toner supply amount at the end of life of the developing apparatus, and when the opening ratio is large, the fogging occurs due to the excess supply amount of the toner at a time when the developing apparatus is new. Further, when the opening ratio is 50%, the solid image follow-up failure occurs even at a time when the developing apparatus is new. That is, in the configuration of the developing apparatus of this embodiment, the defects of images do not occur in the vicinity of 75% of the opening ratio. However, it is very difficult to form a polyurethane sponge layer only in the vicinity of 75% of the opening ratio.

In contrast, the toner supplying roller of the present invention has a predetermined relationship of B/A·C/A·D/A, whereby the opening ratio keeping the toner supply amount to be appropriate can be obtained throughout the life. First, the relationship between the B/A·C/A·D/A, the opening ratio, and the number of images to be formed of the toner supplying roller of the present invention is shown in Table 4.

TABLE 4

| | | Number of images to be formed | Opening ratio (%) | Area ratio (%) B/A | C/A | D/A |
|---|---|---|---|---|---|---|
| Conditions for consideration | 1 | 0 | 55 | 55 | 35 | 10 |
| | | 500 | 83 | 83 | 7 | 10 |
| | | 1000 | 90 | 90 | 0 | 10 |
| | 2 | 0 | 55 | 55 | 20 | 25 |
| | | 500 | 71 | 71 | 4 | 25 |
| | | 1000 | 75 | 75 | 0 | 25 |
| | 3 | 0 | 75 | 75 | 20 | 5 |
| | | 500 | 91 | 91 | 4 | 5 |
| | | 1000 | 95 | 95 | 0 | 5 |
| | 4 | 0 | 75 | 75 | 10 | 15 |
| | | 500 | 83 | 83 | 2 | 15 |
| | | 1000 | 85 | 85 | 0 | 15 |

The developing apparatus used for forming images in this embodiment can print 1000 sheets, and in this experiment, the coverage rate was set so that toner would be out at a time of the printing of 1000 sheets. The toner supplying roller opening ratio under the conditions for consideration 1 and 2 is 55% at a time when the developing apparatus is new. At the end of life of the developing apparatus, the opening ratio has reached 75%, which shows that the solid image follow-up properties are satisfactory. Further, the opening ratio is 71% when 500 sheets of images are formed under the condition for consideration 2, and the solid image follow-up properties are satisfactory because the toner has not been degraded. The toner supplying roller opening ratio under the conditions for consideration 3 and 4 is 75% when the developing apparatus is new, and thus, no problems arise though the opening ratio increases as the formation of images progresses.

According to the above-mentioned experimental results, the opening ratio required at a time when the developing apparatus is new is 55%≦opening ratio≦75%, and the opening ratio required at a time of the end of life is 75%≦opening ratio≦95%.

Further, there is an opening ratio production variation of about ±10% in the toner supplying roller of a polyurethane sponge layer adopted in this embodiment. Therefore, in the case where the toner supplying roller is produced at an opening ratio of 65±10(%), at least 20% is required as an opening ratio increase percentage. Further, 5% of D/A of the skeletal structure portion is required in order for the toner supplying roller in this embodiment to have hardness and elasticity at least required for forming images, and hence the opening ratio at a time of the end of life is 95% or less.

According to this embodiment, when the surface area of the toner supplying roller is A, the total area of the foam cell opening portions is B, and the surface area of the unopened cells is C, a developing apparatus in which the defects of images do not occur can be provided by satisfying the following relationship:

$$\frac{B}{A} + 0.2 \leqq \frac{B+C}{A} \leqq 0.95.$$

The method of producing a toner supplying roller of the present invention is not particularly limited except for setting a cored bar in a forming die previously, and the toner supplying roller may be produced according to an ordinary method. An example thereof is as follows. Polyetherpolyol, polyisocyanate, a catalyst, and a foam stabilizer, water and other assistances, etc., if desired, are mixed homogeneously to prepare a urethane material. After that the urethane material is injected into the die and foamed and cured by heating, whereby urethane foam can be formed.

Though there is no particular limit to the temperature and time for mixing the urethane material, the mixing temperature is usually 10 to 90° C. and preferably 20 to 60° C., and the mixing time is usually 1 second to 10 minutes, and preferably 3 seconds to 5 minutes.

Regarding the foaming and curing by heating, a conventionally known method may be used. There is no particular limit to the foaming method, and any of the method using a foaming agent, the method of mixing air bubbles by mechanical agitating, and the like can be used. The temperature of the forming die at a time of foaming and curing is preferably 35 to 100° C., and more preferably 40 to 80° C. Note that the foaming magnification is not particularly limited and may be appropriately determined depending upon the urethane material, the desired hardness of urethane form, and the like.

In this embodiment, according to the above-mentioned production method, the amount of a catalyst, the foaming and curing time, and the like are set to be appropriate, whereby the number of unopened cells closed by a skin layer on the surface of the toner supplying roller, and the film thickness of the skin layer are controlled.

Note that, in the case where a bias applied to the supplying roller is changed depending upon the environment such as a low-temperature and low-humidity environment (hereinafter, referred to as LL environment) and a high-temperature and high-humidity environment (hereinafter, referred to as HH environment), it is desirable to set an optimum opening ratio depending upon the bias to be applied to a normal-temperature and normal-humidity environment (hereinafter, referred to as NN environment). This is because when the optimum opening ratio is set in the NN environment in which the developing apparatus is generally used instead of the particular environments such as the LL environment and the HH environment, the effect of preventing the defects of images caused by the excess or shortage of toner supply is high throughout the life of the developing apparatus.

For example, the LL environment refers to a temperature of 15° C. and a humidity of 10%, the HH environment refers to a temperature of 30° C. and a humidity of 80%, and the NN environment refers to a temperature of 23° C. and a humidity of 60%.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2008-138052, filed May 27, 2008, and 2008-253997, filed Sep. 30, 2008 which are hereby incorporated by reference herein their entirety.

What is claimed is:

1. A toner supplying roller, which is used in a developing apparatus comprising: a toner carrying member that conveys toner to a developing portion, which is opposite to an image bearing member, the toner supplying roller that abuts against the toner carrying member to supply the toner onto the toner carrying member; and a regulating member that regulates an amount of the toner supplied onto the toner carrying member, the toner supplying roller comprising:

a foam elastic member provided on a surface of the toner supplying roller, the foam elastic member having the following characteristics:

(1) an average diameter of a foam cell opening portion on a surface of the foam elastic member is 100 to 800 μm, (2) an unopened cell closed by a skin layer of a film thickness of 50 μm or less is present in the surface of the foam elastic member, and (3) assuming that a surface area of the foam elastic member is A, a total area of the foam cell opening portions is B, and a surface area of the unopened cell is C, the following relationship is satisfied:

$$\frac{B}{A} + 0.2 \leqq \frac{B+C}{A} \leqq 0.95.$$

2. A developing apparatus, comprising:

a toner carrying member that conveys toner to a developing portion, which is opposite to an image bearing member;

a regulating member that regulates an amount of the toner supplied onto the toner carrying member; and a toner supplying roller that abuts against the toner carrying member to supply the toner onto the toner carrying member, the toner supplying roller comprising a foam elastic member provided on a surface of the toner supplying roller and having the following characteristics:

(1) an average diameter of a foam cell opening portion on a surface of the foam elastic member is 100 to 800 μm, (2) an unopened cell closed by a skin layer of a film thickness of 50 μm or less is present in the surface of the foam elastic member, and (3) assuming that a surface area of the foam elastic member is A, a total area of the foam cell opening portions is B, and a surface area of the unopened cell is C, the following relationship is satisfied:

$$\frac{B}{A} + 0.2 \leqq \frac{B+C}{A} \leqq 0.95.$$

3. A developing apparatus according to claim 2, wherein a potential difference that allows the toner to move to the toner carrying member is provided between the toner carrying member and the toner supplying roller, and relationships: 30%≦B/A≦50% and 50%≦(B+C)/A≦95% are satisfied.

4. A developing apparatus according to claim 2, wherein a potential of the toner carrying member is set to be the same as a potential of the toner supplying roller, and relationships: 55%≦B/A≦75% and 75%≦(B+C)/A≦95% are satisfied.

5. An image forming apparatus, comprising:

an image bearing member; and a developing apparatus that develops a latent image formed on the image bearing member;

the developing apparatus comprising:

a toner carrying member that conveys toner to a developing portion, which is opposite to the image bearing member;

a regulating member that regulates an amount of the toner supplied onto the toner carrying member; and a toner supplying roller that abuts against the toner carrying member to supply the toner onto the toner carrying member, the toner supplying roller comprising a foam elastic member provided on a surface of the toner supplying roller and having the following characteristics:

(1) an average diameter of a foam cell opening portion on a surface of the foam elastic member is 100 to 800 μm, (2) an unopened cell closed by a skin layer of a film thickness of 50 μm or less is present in the surface of the foam elastic member, and (3) assuming that a surface area of the foam elastic member is A, a total area of the foam cell opening portions is B, and a surface area of the unopened cell is C, the following relationship is satisfied:

$$\frac{B}{A} + 0.2 \leqq \frac{B+C}{A} \leqq 0.95.$$

6. An image forming apparatus according to claim 5, wherein a potential difference that allows the toner to move to the toner carrying member is provided between the toner carrying member and the toner supplying roller, and relationships: 30%≦B/A≦50% and 50%≦(B+C)/A≦95% are satisfied.

7. An image forming apparatus according to claim 5, wherein a potential of the toner carrying member is set to be the same as a potential of the toner supplying roller, and relationships: 55%≦B/A≦75% and 75%≦(B+C)/A≦95% are satisfied.

* * * * *